US009878571B2

(12) United States Patent
Kelly

(10) Patent No.: US 9,878,571 B2
(45) Date of Patent: Jan. 30, 2018

(54) MAGIC WINDOW VIEWER, A DIE FOR CUTTING VIEWER PARTS, AND A PREPRINTED SHEET FROM WHICH TO CUT VIEWER PARTS

(71) Applicant: Structural Graphics, LLC, Essex, CT (US)

(72) Inventor: Charles Robert Kelly, Wilmington, DE (US)

(73) Assignee: Structural Graphics, LLC, Essex, CT (US)

( * ) Notice: Subject to any disclaimer, the term of this patent is extended or adjusted under 35 U.S.C. 154(b) by 237 days.

(21) Appl. No.: 14/896,791

(22) PCT Filed: Jun. 10, 2014

(86) PCT No.: PCT/US2014/041648

§ 371 (c)(1),
(2) Date: Dec. 8, 2015

(87) PCT Pub. No.: WO2014/200971

PCT Pub. Date: Dec. 18, 2014

(65) Prior Publication Data

US 2016/0121638 A1 May 5, 2016

Related U.S. Application Data

(60) Provisional application No. 61/833,236, filed on Jun. 10, 2013.

(51) Int. Cl.
*G09F 1/04* (2006.01)
*B42D 25/21* (2014.01)
(Continued)

(52) U.S. Cl.
CPC ..... *B42D 25/21* (2014.10); *B26D 1/0006* (2013.01); *B26F 1/44* (2013.01); *B42D 15/0086* (2013.01);
(Continued)

(58) Field of Classification Search
CPC ..... G09F 1/00; G09F 1/04; G09F 1/10; G09F 23/10; G09F 1/08; G09F 3/08;
(Continued)

(56) References Cited

U.S. PATENT DOCUMENTS 4,021,950 A 5/1977 Asija
6,058,640 A * 5/2000 Young ..... G09F 11/00 40/445
(Continued)

FOREIGN PATENT DOCUMENTS

KR 2000-0034023 A 6/2000

OTHER PUBLICATIONS

Machine Translation of KR 2000-0034023 A, 2 pages.
(Continued)

*Primary Examiner* — Cassandra H Davis
(74) *Attorney, Agent, or Firm* — Ware, Fressola, Maguire & Barber LLP

(57) ABSTRACT

An apparatus, comprising a handle of a captive but freely-moveable wand, the handle useable to move an attached wand viewfinder over a clear front window of a front component to selectively reveal parts of printed matter on a hidden back component, wherein the clear front window has semi-transparently printed matter thereon, wherein inside the apparatus, a concealed component tethered to the wand is selectively moveable between the semi-transparently printed matter and the printed matter on the hidden back component, and wherein the tethered concealed component has an opening that lies in alignment with a matching opening in the wand viewfinder so that, with selective movement of the tethered concealed component: (a) both the printed matter on the clear front window is shown superimposed over the selectively revealed parts of the printed matter on the back component in the wand view finder and
(Continued)

(b) solely the semi-transparently printed matter is shown on the clear front window outside the wand viewfinder.

12 Claims, 6 Drawing Sheets

(51) Int. Cl.

| | |
|---|---|
| ***B42D 15/00*** | (2006.01) |
| ***B42D 15/02*** | (2006.01) |
| ***B42D 15/04*** | (2006.01) |
| ***B26F 1/44*** | (2006.01) |
| ***B42D 25/20*** | (2014.01) |
| ***B42D 25/351*** | (2014.01) |
| ***B26D 1/00*** | (2006.01) |

(52) U.S. Cl.
CPC ..... *B42D 15/027* (2013.01); *B42D 15/042* (2013.01); *B42D 15/045* (2013.01); *B42D 25/285* (2014.10); *B42D 25/351* (2014.10); *G09F 1/04* (2013.01); *B26D 2001/006* (2013.01); *B26F 2001/4418* (2013.01)

(58) Field of Classification Search
CPC .. B42D 15/042; B42D 15/045; B42D 15/047; B42D 15/04; A63H 33/22
See application file for complete search history.

(56) References Cited

U.S. PATENT DOCUMENTS

| | | | | |
|---|---|---|---|---|
| 6,061,938 | A * | 5/2000 | Young | G09F 11/00 116/321 |
| 6,153,039 | A * | 11/2000 | Jacobsen | B42D 15/02 156/253 |
| 6,623,366 | B2 | 9/2003 | Fiedler | |
| 7,258,592 | B2 | 8/2007 | Colak | |
| 8,272,154 | B2 | 9/2012 | Sapp et al. | |
| 2011/0099863 | A1* | 5/2011 | Burtch | G09F 3/20 40/491 |
| 2015/0266329 | A1* | 9/2015 | Kelly | G09F 3/08 40/124.191 |

OTHER PUBLICATIONS

English abstract of KR 2000-0034023 A, 1 page.
Notification of transmittal of the ISR and the Written Opinion of the ISA for International Application No. PCT/US2014/041648 (1 page Form PCT/ISA/220), ISR (2 pages including Form PCT/ISA/210 (first sheet) and Form PCT/ISA/210 (second sheet)), and the Written Opinion of the ISA (4 pages including Form PCT/ISA/237 (cover sheet), Form PCT/ISA/237 (Box No. I), Form PCT/ISA/237 (Box No. V), and Form PCT/ISA/237 (Supplemental Box)), 7 pages total.
Search History by the ISA/US for application No. PCT/US2014/041648, dated Sep. 22, 2014, 4 pages total.

* cited by examiner

MAGIC WINDOW VIEWER, A DIE FOR CUTTING VIEWER PARTS, AND A PREPRINTED SHEET FROM WHICH TO CUT VIEWER PARTS

BACKGROUND

There are a few "magic window" devices which permit the combining of an obscured printed image with a superimposed image printed on a transparent substrate. Such devices lack flexibility and versatility. A problem is that they are not particularly effective in engaging a user.

SUMMARY

What is needed is a "magic window" device that, by giving the user more freedom of operation, adds an interactive surprise effect such that it becomes puzzling for the user to understand how such an effect can be carried out under the interactive control of the user. By allowing the user to manipulate the device more fully, e.g., by allowing control of motion, orientation, and position of a viewfinder, the resultant interactivity and user control accompanied by surprise and puzzlement would exhibit a truly "magical" quality and lead to a more delightful user experience.

For example, according to teachings hereof, an apparatus is provided with a captive but free-floating wand with a viewfinder at an end of the wand, the viewfinder moveable over semi-transparently printed matter shown on a transparent top part of the apparatus, wherein inside the apparatus, a concealed part of the apparatus is tethered to the wand and travels with movement of the wand between the transparent top part and a hidden bottom part of the apparatus, wherein the tethered concealed part blocks the hidden bottom part from view except through an opening in the concealed part underlying the viewfinder so that movement of the wand shows both the semi-transparently printed matter and opaque printed matter on the bottom part superimposed in the viewfinder.

Such a device can be used as a premium item, a greeting card, a direct mailer, a point of sale display, a magazine insert, as part of a packaging application, or any number of similar printed applications.

DETAILED DESCRIPTION

Figure 1:
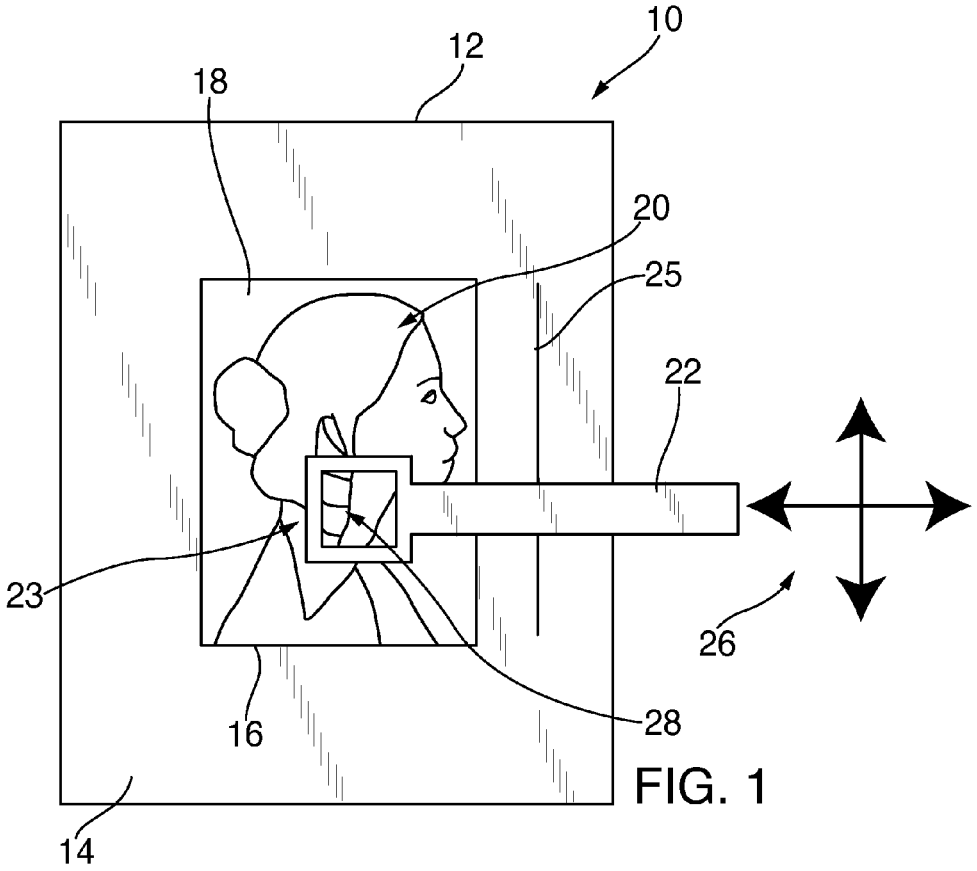
FIG. 1 shows a front view of an embodiment of an apparatus, according to the present invention.
Figure 3:
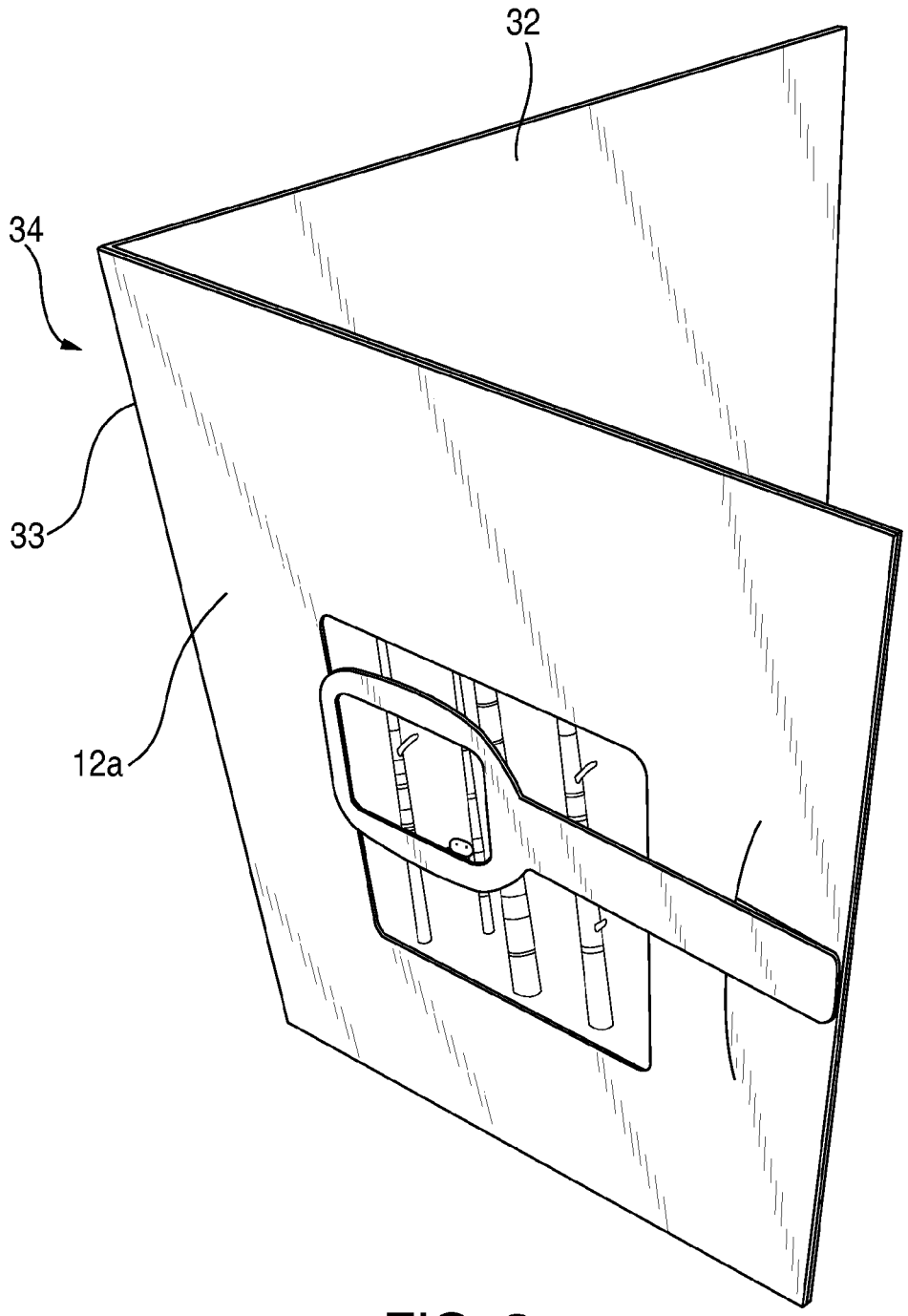
FIG. 3 shows a perspective view of a novelty device that includes an apparatus, according to an embodiment of the present invention.

FIG. 1 shows a front view of an embodiment of an apparatus 10, according to the present invention. The apparatus 10 may be produced as a standalone "magic window" device or may be combined with other component parts, such as shown in FIG. 3, to form various novelty devices that incorporate an apparatus such as disclosed herein.

In the embodiment of FIG. 1, a front panel 12 of the apparatus 10 provides a frame or border 14 surrounding an opening 16 for presenting a printed transparent window 18. For instance, a transparently clear, 4 mm sheet of Mylar material may be cut to size larger than the opening 16 and glued or otherwise fastened to the back of the front panel 12 as shown for instance at reference numeral 18*a* in FIG. 6. It then serves to function like a pane of glass though which the user may be provided a view into the apparatus. Printed matter on the transparent material 18*a* may for instance be a head and shoulders profile 20 of an attractive young woman as shown (in outline) which may be provided in color, such as printed matter in the form of a reproduction of a color photograph. The photographic effect may for instance be carried out using a halftone reprographic technique that simulates continuous tone imagery through the use of dots that vary in one or more of size, shape, or spacing. Use of other reproduction methods to produce the printed matter is of course possible. The manner of printing of the printed transparent window 18 may be such that the printed matter is itself transparent or semi-transparent. Thus the printed matter, e.g., the exemplary colored profile 20 may be printed in such a way that it is not opaque to the transmission of light. When depositing a thin layer of various color inks onto a transparent Mylar sheet, for instance by use of a halftone printing process, the resultant printed matter is naturally transparent to the transmission of light. The various colors (for instance include yellow, magenta, cyan, and black) may be deposited as various sized, shaped, and spaced ink dots. The printed matter may also include line art.

Behind the front panel 12 is a back panel (not shown in FIG. 1 but see reference numeral 48 in FIG. 6) with printed matter on at least one side. The back panel may be made of high quality paper board such as Solid Bleached Sulfate (SBS) stock used for high end packaging where the quality of any printed image is required to be at a high level. The front panel 12 may also be made of the same high quality SBS stock. The at least one side of the back panel with printed matter faces the back of the front panel 12. The printed matter on the back panel may be sized and positioned to match the size of the opening 16 in aligned registration therewith. Or it may be slightly larger to avoid showing any surrounding white coloration from the surrounding unprinted paper board near edges of the window. When depositing a thin layer of various color inks onto the back panel sheet, for instance by use of a halftone printing process onto the bleached white surface of SBS stock, the resultant printed matter is naturally opaque to the transmission of light. The various colors (for instance include yellow, magenta, cyan, and black) may be deposited as various sized, shaped, and spaced ink dots. The printed matter may also include line art. The back panel may itself be sized to match the size of the front panel so that they are in matching size alignment when folded over onto each other into a parallel, layered relationship. The front panel and the back panel may be foldable parts of a same piece of SBS stock such as shown by the respective reference numerals 12*a*, 48 in FIG. 4.

Figure 10:
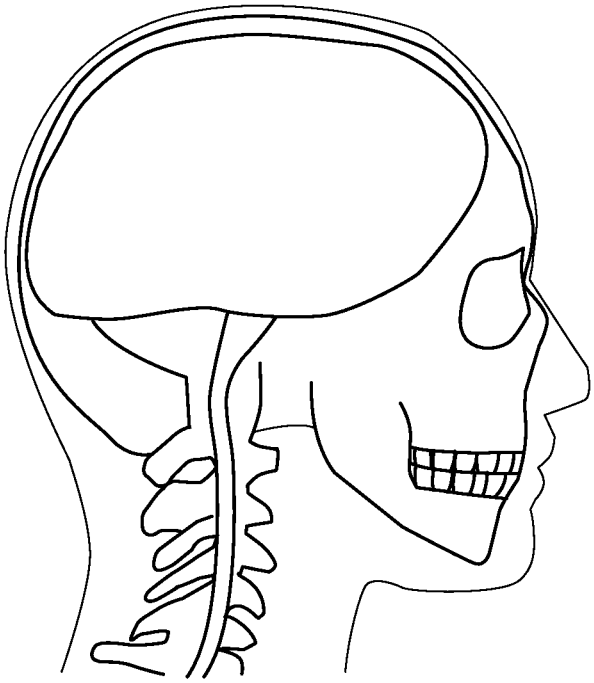
FIG. 10 (not to scale) shows the outlines of printed matter that corresponds to the printed matter of FIG. 1, in this case, an x-ray profile corresponding to the head and shoulder profile shown in FIG. 1.

Importantly, the printed matter on the back panel "corresponds" to the printed matter on the printed transparent window 18. Such correspondence may take many different forms. For instance, a boldly printed (halftone black & white) x-ray profile of the head and shoulders of a human skeleton may be provided underlying and in registration with the colored profile of the attractive young woman presented in the halftone printed transparent window. FIG. 10 (not to scale) shows the outlines of such an x-ray profile. In practice, as previously mentioned, it might be printed with a black and white halftone reprographic technique to simulate the continuous tone of an actual x-ray image with a range of greys. The "correspondence" is in this embodiment the more or less overall registration of the color profile with the x-ray profile. It should be realized that the x-ray illustration of FIG. 10 is sized to match the profile of FIG. 1 so the registration of the two profiles may be carried out so as to achieve the color profile of FIG. 1 in overlying alignment with the grey tone x-ray profile of FIG. 10. In this way, the opaque black & white printed matter on the back panel may be seen through the transparent colored printed matter within the viewfinder. Another correspondence example will be shown below in connection with FIG. 6 but others are of course possible, limited only by artistic imagination.

Figure 2:
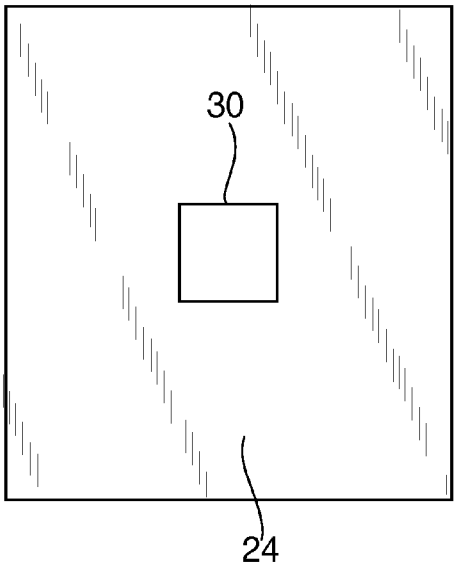
FIG. 2 shows a concealed component part in the form of a panel with an opening, according to the embodiment of FIG. 1 and tethered to the wand shown in FIG. 1.
Figure 4:
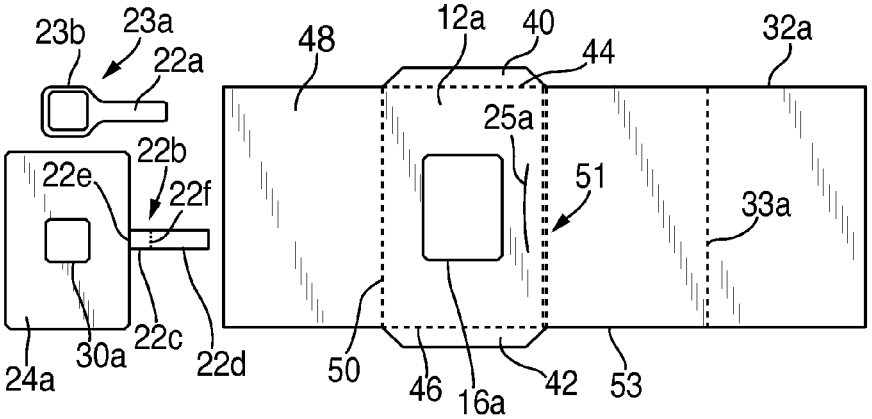
FIG. 4 shows all but one of the parts that may be assembled into a device such as the novelty device of FIG. 3.

A magic wand 23 is provided with a viewfinder attached to the end of a handle or tab 22. The viewfinder may be square, rectangular, circular, or any other desired shape. The magic wand resembles a magnifying glass with a handle, and as such, the magic wand attracts the user's attention by in effect inviting the user to grab the handle 22 and move the viewfinder which, the user will discover, is free-floating in a plane parallel to the front panel. The tab or handle 22 of the magic wand 23 may be attached by an appendage (not shown) through a slot 25 in the front panel 12 to a concealed opaque panel 24 (see FIG. 2) lying under the printed transparent window and above the printed matter on the back panel 48. The opaque panel 24 may be made of SBS stock without any printed matter, e.g., it may be bleached white in color with no printed matter thereon. Under the control of the user's movements 26 of the wand 23, the concealed panel 24 may be made to likewise move in any planar direction 26, i.e., by controlling movement of the handle or tab 22. Thus the concealed opaque panel 24 is made to travel or slide in a narrow planar space between the printed matter on the printed transparent window 18 on front panel 12 and the printed matter on the bottom panel. If the opaque panel 24 is completely devoid of printed matter (e.g., completely white), its movement (tethered to the movements of the magic wand) under the profile 20 will not be visible to the user. Because the concealed panel 24 is smaller in size than the front and back panels, it may even be rotated to some degree depending on the relative size difference. Such rotation of the magic wand 23 is about an axis perpendicular to the plane of the front panel. The user may simply tilt the handle 22 slightly in an up or down lateral direction and thereby exert a twist force on the handle and appendage or tab 22*a*, 22*b*. A narrow field of view 28 of less than the totality of the field of view of the printed matter on the back panel may be provided through a viewfinder on the end of the wand 23. That narrow field of view helps contribute to the illusion of a "magic window" frame or in the case of FIG. 1, a "magic x-ray window" frame around an opening 30 in the concealed opaque panel 24 and through the semi-transparent printed matter on the printed transparent window 18 that overlies the concealed panel 24. In moving the narrow field of view of the viewfinder about within the wider field of view of a scene represented by the printed matter on the back panel, the user gets to search with excitement and delight for possibly multiple hidden surprises awaiting. The term tab is also used to mean any appendage attached to the concealed panel 24 and the viewfinder so as to be useable for pulling, pushing, or otherwise maneuvering the concealed panel 24 in any planar direction parallel to the front and back panels. As shown in FIG. 4 below, the concealed panel 24 may itself provide a complementary tab extending from a side thereof for attachment to the tab 22 of the wand 23. An appendage for passing through the slot 25 may instead be provided separately. Or, the tab 22 may include an appendage for passing through the slot 25 and attachment to the concealed panel or to a tab thereof. Any such appendage or tab or combination thereof should be sufficiently rigid to be able to move the concealed panel in concert with the user's movement of the handle or tab 22, i.e., without undue slack so as to create a unified impression that the viewfinder on the end of the wand 23 and the opening 30 are one and the same even though they are not actually connected in the vicinity of the viewfinder (since they lie on opposite sides of the printed transparent window 18).

In various embodiments, the degree of transparency of the printed matter of the printed transparent window 18 may be controlled in relation to the degree of visibility required of the underlying printed matter on the back panel through the semi-transparently printed matter on the printed transparent window 18. The correspondence between the printed matter on the back panel and the printed matter on the printed transparent window 18 may include printed matter on the back panel that is visible directly, i.e., not seen or to be viewed through parts of the semi-transparent printed matter but merely seen in some relation or correspondence thereto. See for instance the forest animals and cartoon character in FIG. 6. In this way also, the printed matter on the back panel may graphically "correspond" to the printed matter on the printed transparent window in a way that perplexes the user as to how the hidden matter can be exposed by simple movement of the magic window about in a planar motion, under the user's random volitional control, to produce a surprising, humorous, or amusing effect for the user.

FIG. 3 shows a perspective view of a novelty device that includes an apparatus, according to an embodiment of the present invention. In the illustrated novelty device, a rectangular sheet of paper board (see FIG. 4) such as high quality SBS stock is folded to form a plurality of overlapping panels. The particular novelty device of FIG. 3 incorporates an apparatus such as shown in FIG. 1 by means of a sheet such as presented FIG. 4. The novelty device is shown standing upright on a horizontal surface such as a tabletop. As shown, the novelty device has four overlapping panels, one of which is not visible in the illustration because it is folded within two other panels. The hidden panel corresponds to the back panel described above in connection with FIG. 1. The front facing panel 12*a* in FIG. 3 corresponds to the front panel 12 of FIG. 1. An openable panel 32 (see panel 32*a* in FIG. 4) is operable to be opened as shown unfolded from a folded state, i.e., swung open about a fold line 33 or axis defining a corner 34 so as to be made apart from the front panel 12*a* and the back panel that are fastened together, e.g. glued together to form front and back panel parts of the illustrated apparatus (as in FIG. 1). It should be understood that the openable panel 32, though useable in many products, is not necessarily present. Nevertheless, for novelty devices such as shown in FIG. 3, a user may swing the openable panel 32 of the novelty device about the fold line 33 along the corner 34 to the open position as shown to allow the novelty device to be stood upright on the tabletop as shown or to allow for a reading of a greeting or the viewing of other graphic matter printed on the part of openable panel 32 facing the front and back panels when in the folded state. The surface of the openable panel 32 may for instance have printed matter thereon such as a greeting card type message, graphics, or both. For example, for the embodiment of the apparatus shown in FIG. 1, a novelty device might be provided with the symbolic work of art as shown on the front panel of FIG. 1 as the front of a greeting card with a humorous message printed on the openable panel 32 intended for an epicurean friend.

Figure 5:
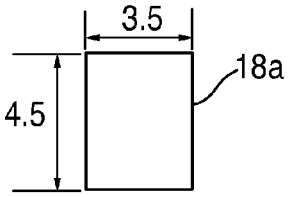
FIG. 5 shows the concealed panel part that may be assembled along with the parts shown in FIG. 4 into a device such as the novelty device of FIG. 3.

FIGS. 4 and 5 together show parts that may be assembled into a device such as the novelty device of FIG. 3.

Figure 6:
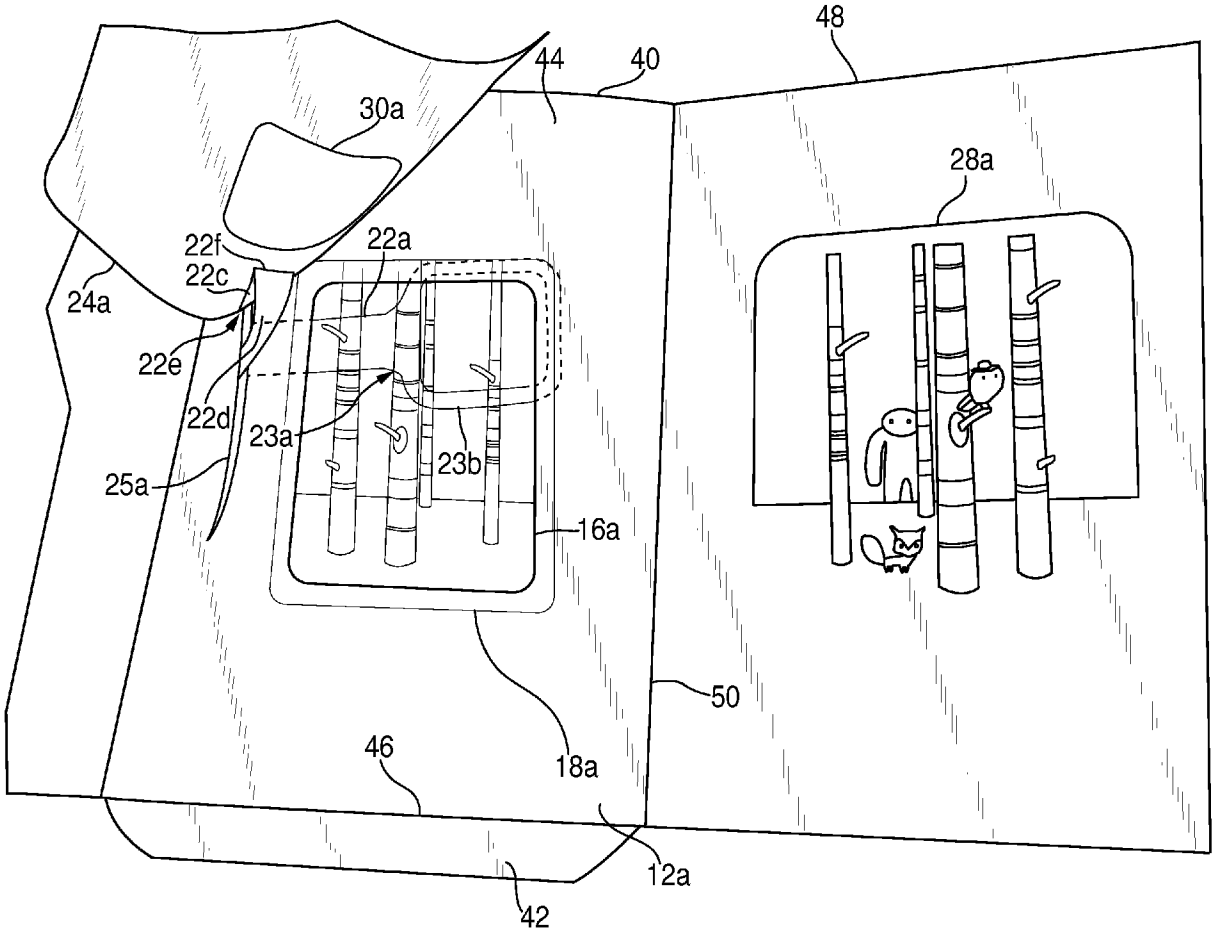
FIG. 6 shows how the tab of the wand is threaded through the slot of the front panel and attached to the concealed panel so that the concealed panel is tethered to the wand.

FIG. 4 shows a rectangular sheet of paper board with four panel sections separated by vertically scribed fold lines that serve for ease in folding the panels into overlying relationship during assembly. A front panel 12*a* has a central opening 16*a*, a slot 25*a*, and top and bottom folding tabs 40, 42 that fold along respective scribed fold lines 44, 46. A back panel 48 is folded (downwardly into the plane of FIG. 4) and all the way around (one hundred and eighty degrees) so as to be aligned with the front panel 12*a* with printed matter on its underside appearing within the opening 16*a* and in registration therewith. In other words, if looking down over the top edge of the sheet, the panel 48 is rotated 180° clockwise about an axis defined by the scribed line 50 so as to lie in parallel facing the back of the front panel 12*a*. The front panel 12*a* is then parallel to the back panel 48 and the printed matter on the back panel 48 is visible through the front panel opening 16*a*. As shown in FIG. 6, the back panel 48 may have printed matter on at least one side as shown at reference numeral 28*a*. In particular, when folded over, the at least one side with printed matter 28*a* faces the front panel 12*a* and is aligned with the opening 16*a* in such a way that the printed matter on the transparent window panel is in the desired correspondence with the printed matter 28*a* on the back panel 48. For instance, the alignment may be such that the trees printed transparently or semi-transparently on the transparent window panel 18*a* in FIG. 6 are aligned with and overlie the boldly printed trees in the printed matter 28*a* on back panel 48 so that the transparent trees exactly match the underlying boldly printed trees. In this way, the user is presented with the two separate printed matters as a unified one printed matter. The woodland animals and the cartoon character appear on the printed matter on the back panel only but are nonetheless presented in this example in spatial, perspective, or at least positional "correspondence" with the printed tree matter on both the front panel and the back panel.

A clear, printed transparent window panel 18*a* is shown in FIGS. 5 and 6. It is glued or otherwise attached to the back of front panel 12*a* so as to be affixed behind the opening 16*a*. After assembly, it is thus situated between and parallel to the front panel and the back panel and is immobile with respect to the back panel and the front panel. The panel 18*a* may be made slightly larger, e.g., 3.5 inch×4.5 inch (88.9 mm×114.3 mm) than the opening 16*a* (e.g., 2 9/16 inch×3 7/16 inch (65.1 mm×87.33 mm)) to provide extra space for overlap of peripheral edges on the backside of panel 12*a* for ease in gluing. As described previously and as shown in FIG. 6, the transparent panel 18*a* is provided with transparent or semi-transparent printed matter (trees shown printed faintly with transparency) on at least one side that corresponds to the printed matter (corresponding trees and woodland animals and cartoon/goblin character printed on the white stock so as to appear opaque on the at least one side of the back panel 48 and overlies same with exact registration so as to align at least parts (e.g. trees) of the two sets of printed matter. The printed matter 28*a* may have overall dimensions greater than that of the opening 16*a* as shown in FIG. 6. Thus, when folded over, the at least one side with printed matter 28*a* faces the front panel 14 and is aligned with the opening 16*a* in such a way that the printed matter on the transparent window panel is in the desired correspondence with the printed matter 28*a* on the back panel 48. As shown in FIG. 6, the alignment may be such that the trees printed transparently on the transparent window panel 18*a* are aligned with and overlie the boldly printed trees in the printed matter 28*a* on back panel 48 so that, from the perspective of a user viewing the front panel through the magic window 23*b*, there is no perception of there being two sets of printed trees because the transparent trees match the underlying boldly printed trees and are seen as one set of printed trees.

FIG. 4 also shows a wand 23*a* with a handle or wand tab 22*a* attached to a wand viewfinder 23*b* ("magic window") at the end of the wand. A concealed panel 24*a* is also shown with an opening 30*a* and a tab 22*b* extending therefrom. After the above-described 180° foldover of the back panel 48 onto the front panel 12*a* so as to be in parallel alignment therewith, the concealed panel 24*a* may be inserted in the planar space between the folded over back panel 48 aligned with the front panel 12*a*.

Figure 7:
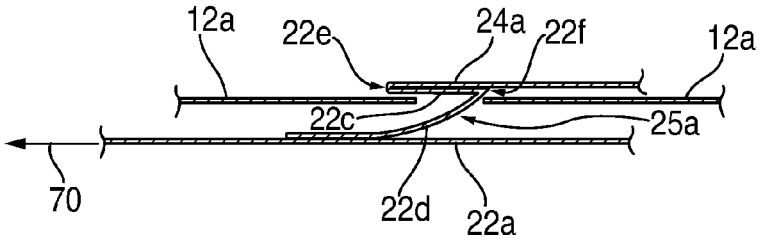
FIG. 7 is a stylized drawing (not to scale) that shows how a short base part of the inner tab of the concealed panel may be folded to form a stop that prevents over extension of the tethered wand.

The tab 22*b* extending from the concealed panel 24*a* may have two sections 22*c*, 22*d* separated by a foldline 22*f*. Prior to insertion of the concealed panel 24*a* between the front panel 12*a* and the back panel 48, a first section 22*c* of tab 22*b* may be attached directly to the concealed panel 24*a*. This may be done by folding the first section 22*c* over at a fold line 22*e* and gluing it to a facing side of concealed panel 24*a* shown in FIG. 4. FIGS. 6 and 7 each show the first section 22*c* folded over and glued to the concealed panel 24*a*. As shown in stylized FIG. 7 (not to scale), tab 22*b* will then be able to serve as a "stop" at the fold line 22*f* against excessive extension of the wand in the direction of the arrow 70 in FIG. 7, and prevent possible tearing damage to the connection between the outer tab 22*a* and the underlying hidden inner tab 22*d*, when the wand is fully extended. This "stop" acts to signal the user to stop trying to extend the wand any further and thereby prevents the connection between the outer tab 22*a* and the inner tab 22*b* from being damaged by the wand 23*a* being pulled out too far with excessive force. During assembly, the second section 22*d* of the inner or hidden tab 22*b* is slipped through a slot 25*a* and glued or otherwise attached at least at an end thereof to the outer or visible tab 22*a* of wand 23*a* as shown in FIG. 7. After connection, the hidden inner tab 22*b* and the outer visible tab 22*a* become a unified tab or "tab assembly" or assembly of appendages that may be grasped by a user as a handle of the wand 23*a* to move the visible viewfinder 23*b* outside the apparatus and the intermediate panel 24*a* hidden inside the apparatus as a unified whole. As shown, the first section 22*c* of the inner hidden tab 22*b* may be shorter than the longer second section 22*d*.

In FIG. 6 the magic window and tab 22*a* may be seen directly and in silhouette through the transparent or semi-transparent printed matter from the rear through the panel 18*a*, as viewed from the backside of the front panel 12*a*. During assembly, after the concealed panel 24*a* is put in place between the front panel 12*a* and the back panel 48 and is tethered to the magic wand 23*a*, the panel 53 is folded over by a counterclockwise rotation about the fold lines 51 and the two tabs 40, 42 may then be folded over and glued to the panel 53 to enclose the apparatus. The vertical pair of scribed lines 51 allow the panel 53 to be folded over without a sharp corner so as to provide a little extra space (depending on the distance between the scribed lines 51) on the corner edge and thereby avoid the panel 53 pressing down too hard on the facing front and back panels when the panel 53 is folded over and glued tight on the other side. This allows the panel 48 after it is folded over to face the rear of the panel 12*a* (as described above) with sufficient space to allow the concealed part 24*a* to move freely in the planar space between the two panels 12*a*, 48.

Upon assembly of the apparatus, the concealed panel 24*a* thus serves as an intermediate panel parallel to the front panel 12*a*, the back panel 48, and the transparent panel 18*a*. The concealed, intermediate panel 24*a* is situated for lateral travel in a sliding motion between the transparent panel 18*a* and the back panel 48. The concealed, intermediate panel 24*a* is smaller than the front panel but larger than the opening 16*a* in the front panel. In an embodiment as shown in FIG. 6, the concealed, intermediate panel may for instance be provided with dimensions of 4 inch×5¾ inch (101.6 mm×146.05 mm). The intermediate panel is visible through a 2⁹⁄₁₆ inch×3⁷⁄₁₆ inch (65.1 mm×87.33 mm) opening in the front panel, the intermediate panel blocking visibility of the printed matter on the at least one side of the back panel except that the intermediate panel has a 1⅜ inch×1⅜ inch (34.925 mm×34.925 mm) square opening that is smaller than the opening in the front panel and that exposes a part of the printed matter 28*a* on the at least one side of the back panel 48. The overall size of the assembly for the described embodiment, as measured from the front panel, may be 5⁷⁄₃₂ inch×7²⁷⁄₃₂ inch (13.26 cm×19.92 cm).

The tab 22*a* connected to the intermediate panel 24*a* is moveable 26 by a user in moving the intermediate panel to expose different parts of the printed matter 28*a* on the at least one side of the back panel 48 through the opening 30*a* in the intermediate panel 24*a*. The intermediate panel is moveable between the transparent panel 18*a* and the back panel 48 in such a way that the opening 30*a* in the intermediate panel 24*a* is moveable within the boundaries of the opening 16*a* of the front panel 12*a*.

Figure 8:
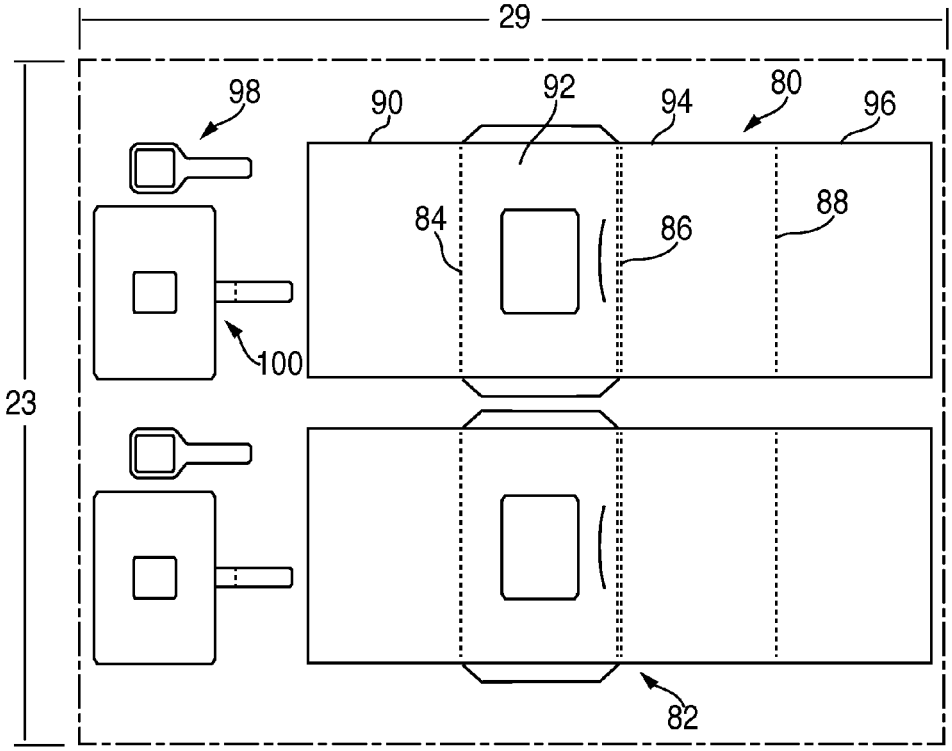
FIG. 8 shows a die cut pattern for cutting one or more stacked sheets or, alternatively, outlines for hand-cutting parts of a hobby kit.
Figure 9:
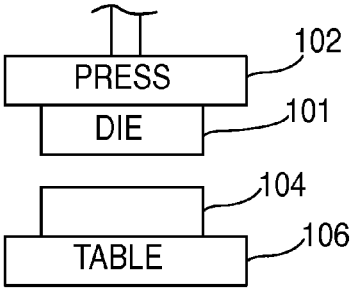
FIG. 9 shows a die with a die cut pattern such as shown in FIG. 8 in a press cutting one or more paper boards to produce parts for assembly into at least one apparatus or a novelty device that includes an apparatus, according to the present invention.

FIG. 8 shows a die cut pattern in solid lines for a die usable for cutting one or more preprinted sheets, e.g., 29×23 inch paper board sheets (73.66 cm×58.42 cm), e.g., one SBS stock sheet with a die cutting machine or press. Before or preferably simultaneous with the cutting operation, an impression die may be used to impress a plurality of fold lines 84, 86, 88 separating a plurality of foldable panels 90, 92, 94, 96 on each sheet as well as other fold lines for the various tabs as shown in dotted lines and more fully described above in connection with FIG. 4. Or, the fold lines may be scored with a scoring instrument. The die cut pattern may provide for cutting parts for only one or even more than the two devices shown in FIG. 8. The illustrated die cut pattern is used to cut preprinted parts from one sheet for assembling two devices, such as described above for instance in connection with FIG. 4, each device also including a separately preprinted clear transparent window 18*a* as shown for instance in FIG. 5 made of a Mylar sheet. A die cut press 102 or top platen shown in FIG. 9 is able to cut the illustrated pattern from a sheet or a stack of sheets 104 set on a table, bottom platen, cutting surface, or area 106 by pressing for instance a steel rule cutting die 101 onto the sheet or sheets 104 to create a plurality of multiple panel parts 80, 82. The die 101 may be in the form of a flat base or substrate or block made for instance out of high-grade and high density plywood, e.g. a hardwood made out of maple that is free from voids and imperfections. A bandsaw or laser cutter may be used to cut precisely positioned slits into the substrate. A hardened steel in the form of an elongated razor blade ("steel rule") is cut and bent by a die-maker and inserted into the slits in the substrate. The steel rule thus assembled in the slits forms thin metal walls held in place in the slits. The edges on one side of the steel rule may have a selected bevel that is sharpened for cutting the SBS stock on the press machine's bottom platen or table 106. The other side faces the top platen or press 102. An ejection rubber pad may be adhered to the substrate of the die to help eject the SBS stock after it is cut. Altogether the walls of the die 101 form a steel rule die that is pressed onto the paper board or boards to do the cutting operation. As suggested above, the die is attached to the top platen of the die cutting press that provides the force required to make the cut. The SBS stock is positioned below the die and then the press is actuated. The cutting edges of the steel rule penetrate through the SBS stock until they come in contact with the bottom platen or table which may be made of steel selected for cutting the SBS stock. The press then reverses and the cut part is exposed. As suggested above, foldlines, creases, perforations and the like may be made with a special rule that is positioned on the same die as the cutting rule. It is also possible to have a secondary foldline die positioned on the opposite side of the press and aligned with the primary foldline rule to create very crisp foldlines or creases. Windows and tabs similar to the window 16*a* and tabs 40, 42 are also provided for die cutting. Provision for cutting a slot similar to slot 25*a* of FIG. 4 is also provided for in the die cut pattern for each multiple part panel 80, 82. As shown to the left of each multiple part panel 80, 82, there is a wand 98 and a concealed part 100 cut by the pattern. The die cut parts may be assembled into a plurality of devices, each device at least including an apparatus according to the teachings hereof. It should be realized that the pattern of FIG. 8 could itself be printed on a sheet of preprinted paper board and used as a cutting guide for hand cutting using scissors for an individual craft or hobby kit or school project. Such a paper board would be preprinted with at least the printed matter for the bottom/back panel, part, or component. In that event, the pattern of FIG. 8 instead represents a paper board sheet preprinted with at least printed matter such as shown at reference numeral 28*a* in FIG. 6 on the panel 90 and actual line printing showing the outline of where to cut (solid lines) and where to fold (dotted lines). The dotted lines may be pre-impressed or pre-scored for easy folding.

The invention claimed is:

1. An apparatus, comprising a captive but free-floating wand with a viewfinder at an end of the wand, the wand freely moveable to move about the viewfinder over semi-transparently printed matter shown on a transparent top part of the apparatus, wherein inside the apparatus, a concealed part of the apparatus is tethered to the wand and travels with movement of the wand between the transparent top part and a hidden bottom part of the apparatus, wherein the tethered concealed part blocks the hidden bottom part from view except through an opening in the concealed part underlying the viewfinder so that movement of the wand shows both the semi-transparently printed matter and opaque printed matter on the bottom part superimposed in the viewfinder.

2. The apparatus of claim 1, wherein the wand is tethered to the concealed part by a tab comprising a hidden tab part connected to the concealed part, wherein the hidden tab part passes through the top part and is attached to a visible part of the tab comprising a handle of the wand.

3. An apparatus, comprising a handle of a captive but freely-moveable wand, the handle useable to move an attached wand viewfinder over a clear front window of a front component to selectively reveal parts of printed matter on a hidden back component as apparently part of semi-transparently printed matter on the clear front window, wherein inside the apparatus, a concealed component tethered to the wand is selectively moveable between the semi-transparently printed matter and the printed matter on the hidden back component, and wherein the tethered concealed component has an opening that lies in alignment with a matching opening in the wand viewfinder so that, with selective movement, the tethered concealed component shows (a) both the printed matter on the clear front window superimposed over the selectively revealed parts of the printed matter on the back component in the wand viewfinder and (b) solely the semi-transparently printed matter on the clear front window outside the wand viewfinder.

4. The apparatus of claim 3, wherein the handle is tethered to the concealed component by a hidden tab connected to the concealed component, wherein the hidden tab passes through the top part and is attached to the handle.

5. An apparatus, comprising:

a back panel with printed matter on at least one side;

a front panel parallel to the back panel, the front panel having a front panel opening and the printed matter on the back panel is visible through the front panel opening;

a transparent panel between and parallel to the front panel and the back panel and immobile with respect to the back panel and the front panel, the transparent panel provided with printed matter on at least one side that corresponds to the printed matter on the at least one side of the back panel;

an intermediate panel parallel to the front panel, the back panel, and the transparent panel, the intermediate panel situated between the transparent panel and the back panel, the intermediate panel smaller than the front panel but larger than the opening in the front panel, the intermediate panel visible through the opening in the front panel, the intermediate panel blocking visibility of the printed matter on the at least one side of the back panel except that the intermediate panel has an opening smaller than the opening in the front panel that exposes a part of the printed matter on the at least one side of the back panel; and a tab connected to the intermediate panel and usable to move the intermediate panel to expose different parts of the printed matter on the at least one side of the back panel through the opening in the intermediate panel, the intermediate panel moveable between the transparent panel and the back panel in such a way that the opening in the intermediate panel is moveable within boundaries of the opening of the front panel.

6. The apparatus of claim 5, wherein the printed matter on the transparent panel is semi-transparent.

7. The apparatus of claim 5, further comprising a panel with printed matter thereon that is unfoldable from a folded alignment with the front panel and the back panel.

8. The apparatus of claim 5, wherein at least one of the back panel and the front panel are made of solid bleached sulfate paper board.

9. The apparatus of claim 5, wherein a hidden part of the tab is connected to the intermediate panel and the hidden tab part passes through a slot in the front panel and is attached under a visible part of the tab.

10. The apparatus of claim 5, wherein the tab has an hidden part having two sections separated by a foldline between a first section nearest to the intermediate panel and a second section extending beyond the foldline and farthest from the intermediate panel, wherein the first section is folded over and glued to the intermediate panel, and wherein the second section passes through a slot in the front panel and is attached to a visible part of the tab.

11. The apparatus of claim 5, wherein the intermediate panel is freely moveable in a lateral plane within the boundaries of the opening of the front panel.

12. The apparatus of claim 11, wherein the intermediate panel is moveable with rotation.

* * * * *